US005509637A

United States Patent [19]

Leonard

[11] Patent Number: 5,509,637

[45] Date of Patent: Apr. 23, 1996

[54] ENGINE VALVE HYDRAULIC ACTUATOR HIGH SPEED SOLENOID CONTROL VALVE

[75] Inventor: Mark L. Leonard, Canton, Mich.

[73] Assignee: Eaton Corporation, Cleveland, Ohio

[21] Appl. No.: 321,944

[22] Filed: Oct. 12, 1994

[51] Int. Cl.[6] ..... F15B 13/044; F16K 13/06

[52] U.S. Cl. ..... 251/129.16; 123/90.12; 137/625.65; 251/129.21

[58] Field of Search ..... 123/90.11, 90.12, 123/90.13; 137/625.65, 625.68; 251/129.21, 129.16

[56] References Cited

U.S. PATENT DOCUMENTS 3,926,159 12/1975 Michelson et al. .
4,513,780 4/1985 Evans ..... 251/129.21 X
4,515,345 5/1985 Inden et al. ..... 251/129.15
4,655,254 4/1987 Hafner et al. ..... 137/625.65
4,791,895 12/1988 Tittizer .
4,821,689 4/1989 Tittizer et al. .
4,930,464 6/1990 Letsche .
5,255,641 10/1993 Schechter .

*Primary Examiner*—Gerald A. Michalsky
*Attorney, Agent, or Firm*—Loren H. Uthoff, Jr.; Howard D. Gordon

[57] ABSTRACT

A control solenoid for an engine valve hydraulic actuator having an electrical coil wound around a coil ring extending from a solenoid housing to magnetically interact with a spool ring attached to a spool valve thereby causing the spool valve to be axially displaced against a restoring force generated by a return spring.

2 Claims, 2 Drawing Sheets

FIG 2
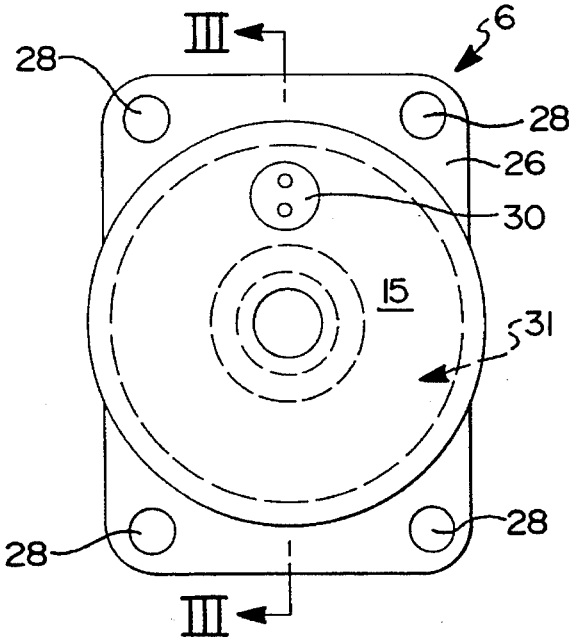
FIG 3
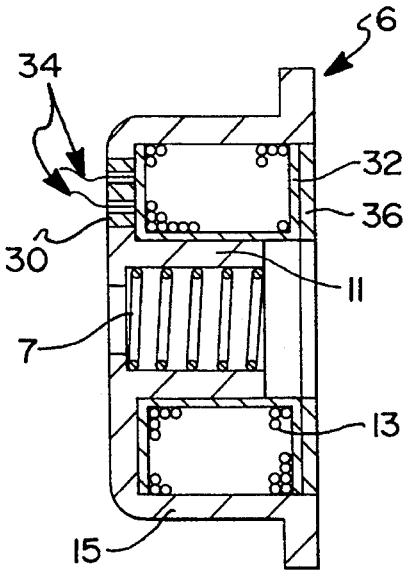
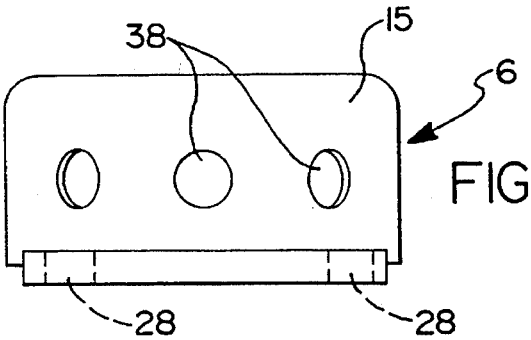
FIG 4
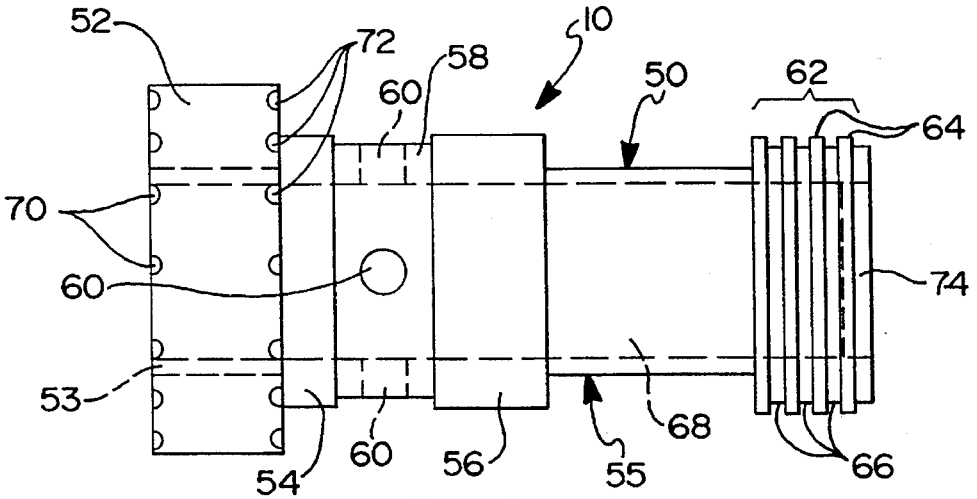
FIG 5

ENGINE VALVE HYDRAULIC ACTUATOR HIGH SPEED SOLENOID CONTROL VALVE

RELATED APPLICATIONS

The present application relates to application U.S. Ser. No. 08/321,704, entitled "Engine Valve Hydraulic Actuator Locating Mechanism", filed on Oct. 12, 1994 and application U.S. Ser. No.: 08/306,794 entitled "Engine Hydraulic Valve Actuator Spool Valve" filed on Sep. 15, 1994 both of which are assigned to the same assignee, Eaton Corporation, as this application.

BACKGROUND OF THE INVENTION

1. Field of the Invention

The present invention relates to a solenoid control valve for a hydraulic engine valve actuator. More specifically, the present invention relates to a solenoid control valve for a hydraulic engine valve actuator using a coil induced electromagnetic field acting on an iron spool ring to translate a spool valve.

2. Description of the Prior Art

A major obstacle to the efficient operation of internal combustion engines has been the timing of the opening and closing of both the intake and the exhaust engine valves. In the ideal situation, both the timing and the lift of the engine valve can be independently regulated by an electronic control unit depending on the operational needs of the engine intake or exhaust. One method to provide for independent operation of the valves is through a hydraulic actuator where a high pressure hydraulic source is used to supply the energy to open and close the valve according to the position of a hydraulic control valve as determined by an electronic control unit. Prior art devices can be seen by reference to U.S. Pat. Nos. 3,926,159; 4,791,895; 4,930,464; 4,821,689; and 5,255,641 the disclosures of which are hereby expressly incorporated by reference.

To control the flow of hydraulic or engine oil through a hydraulic actuator, a solenoid valve is commonly used as disclosed, for example, in U.S. Pat. Nos. 4,957,075, 5,255,641 and 4,200,067 the disclosures of which are hereby expressly incorporated by reference. Solenoid valves are placed on each of the hydraulic lines to turn the flow on and off in response to electronic control signals.

One problem with the use of solenoid valves is that their actions are difficult to synchronize so that the proper valves open and close in precise timing with one another. If one opens or closes at an undesired time in relation to another solenoid valve, erratic action can result. This type of unpredictable behavior can be highly detrimental to the operation of an engine.

Another problem is that high pressure oil with varying viscosities, as is commonly found in a motor vehicle, can further complicate solenoid performance as far as speed of response. Oil condition can affect the separate solenoid control valves of the prior art valve actuators differently depending on several characteristics of the solenoid valve such as wear of the shut off device and the operating clearance.

Still another problem with prior art devices is their stability and ability to operate at a high duty cycle in the harsh environment found in a vehicle engine. Hot oil and heat conducted from the engine cylinder head commonly results in abnormally high operating temperatures which degrade the performance of prior art solenoid.

SUMMARY OF THE INVENTION

The present invention includes a variable engine valve control system comprising a free moving engine intake or exhaust valve with a small piston attached to its top which operates in a bore formed in the main body of a hydraulic valve actuator. The piston is subjected to fluid pressure acting on surfaces on both sides of the piston, with the surfaces being of unequal areas. The volume at one end of the piston is connected to a source of high pressure fluid while the volume at the other end can be connected either to a source of high pressure fluid or to a source of low pressure fluid, or disconnected from them both through action of a controlling means which, according to the present invention, consists of a combination solenoid and spool valve.

Selective actuation and de-actuation of the controlling means causes an inflow of pressurized fluid into the volume at one end of the piston and outflow of fluid from the volume at the other end of the piston, such action leading to a change in the balance of forces acting on the piston and causing movement of the engine valve from one fixed position to another.

The combination solenoid and spool valve are configured to provide a high speed of response in a harsh environment as found on a vehicle engine. The spool valve consists of a lightweight main body made of aluminum on which a magnetically reactive plunger ring is pressed. An electronic coil creates a magnetic field in a solenoid cover and especially within a coil ring which is preferably formed as one piece with the cover which reacts with the plunger ring acting to draw it into the solenoid. A return spring residing in the coil ring tends to force the spool valve in a direction opposite to that induced by the magnetic field.

The solenoid and spool valve assembly are mounted to the sides of an upper and a lower actuator housing with the spool valve axially translating within a valve bore. As the spool valve is moved by the solenoid and the return spring, oil passages are opened and closed so as to cause the engine valve to be moved open and closed according to the control signals generated by an electronic control unit.

One provision of the present invention is to provide a fast acting solenoid and spool valve assembly to control a hydraulic valve actuator.

Another provision of the present invention is to provide a fast acting solenoid and spool valve assembly to control a hydraulic valve actuator under harsh environmental conditions.

Still another provision of the present invention is to provide a fast acting solenoid and spool valve assembly to control a hydraulic valve actuator under a high duty cycle requirement.

BRIEF DESCRIPTION OF THE DRAWINGS

FIG. 2 is a front elevational view of the solenoid of the present invention;

FIG. 3 is a side cross-sectional view of the solenoid as shown in FIG. 2 taken along line III—III;

FIG. 4 is a bottom elevational view of the solenoid of the present invention; and FIG. 5 is a front elevational view of the spool valve of the present invention.

DETAILED DESCRIPTION OF THE PREFERRED EMBODIMENT

Figure 1:
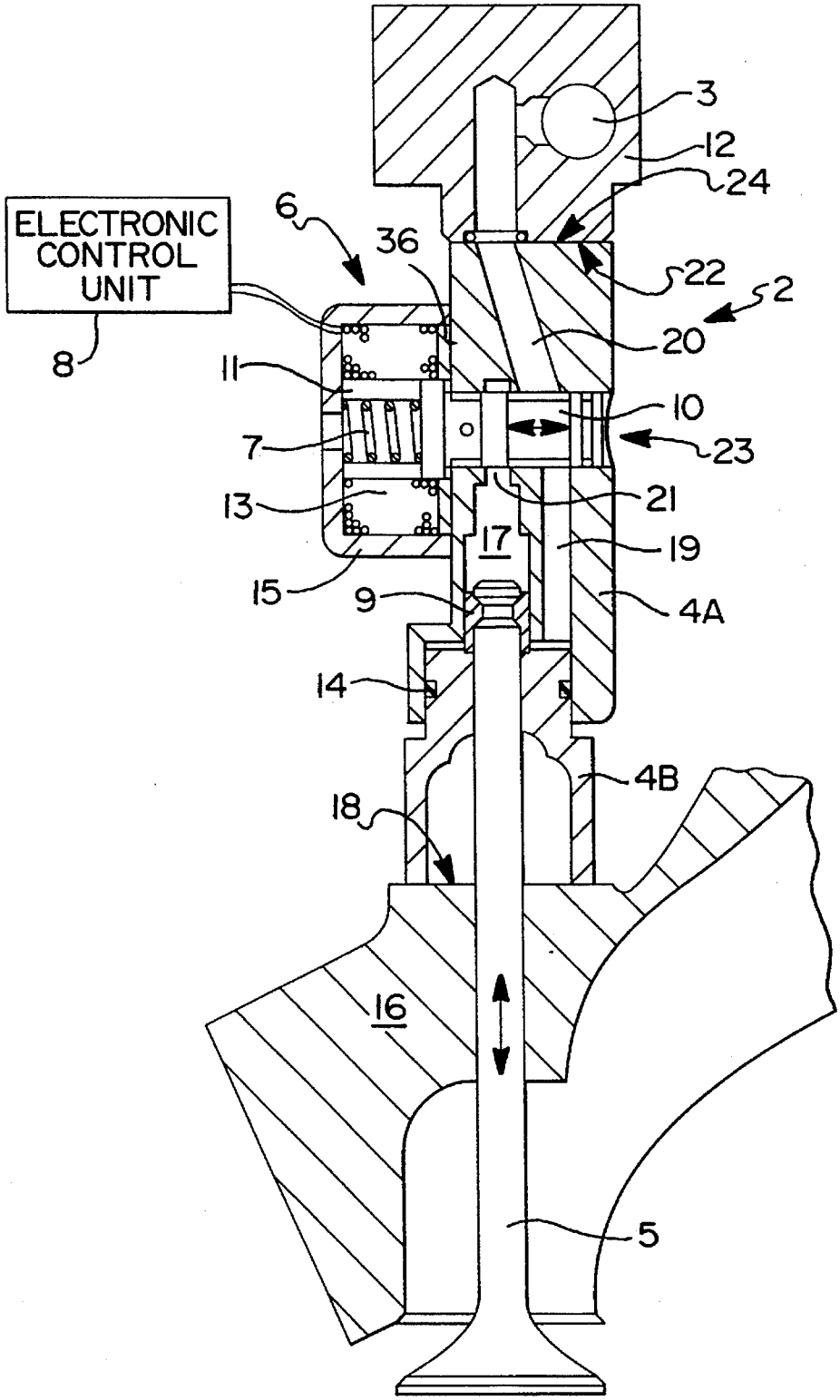
FIG. 1 is a cross-sectional view of the engine valve hydraulic actuator of the present invention.

In this disclosure, certain terminology will be used for convenience and reference only and will not be limiting. For example, the terms "rightward" and "leftward" will refer to directions in the drawings in connection with which the terminology is used. The terms "inwardly" and "outwardly" will refer to directions toward and away from, respectively, the geometrical center of the apparatus being described. The terms "upward" and "downward" will refer to directions as taken in the drawings in connection with which the terminology is used. All foregoing terms include the normal derivatives and equivalents thereof.

Now referring to FIG. 1, the cross-sectional view of the hydraulic actuator 2 of the present invention is shown. A source of high pressure hydraulic oil is fed to the area labeled as oil supply 3 which is used to supply the primary actuation energy to the hydraulic actuator 2 of the present invention to cause an engine valve 5 to translate upwardly and downwardly according to signals supplied by an electronic control unit 8. The hydraulic oil can also be an engine oil as used to supply the basic lubrication to the engine mechanicals.

The hydraulic actuator 2 is comprised of an upper actuator housing 4A slidingly connected to a lower actuator housing 4B. The control solenoid 6 is used to control when the hydraulic actuator 2 is energized or deenergized through the axial motion of the spool valve 10. The spool valve 10 moves laterally leftward and rightward within the valve bore 23 formed in the upper actuator housing 4A so as to control the flow of high pressure oil through the upper actuator housing 4A toward the lower actuator housing 4B and also control the flow of hydraulic oil from the upper actuator housing 4A to atmosphere. When the solenoid 6 is energized, the spool valve 10 is moved magnetically to the left and when de-energized, the spool valve 10 is forced to the right by the return spring 7. The solenoid 6 is comprised of a coil 13 which is wound around a magnetically conductive coil ring 11 (which is preferably formed as one piece with the solenoid housing 15) and contained by solenoid housing 15 which is mounted to the side of the upper actuator housing 4A. The return spring 7 axially forces the spool valve 10 in a rightward direction so as to cause the hydraulic oil contained in an upper piston cavity 17 formed in the upper actuator housing 4A to be vented to atmosphere thereby allowing the engine valve 5 to assume its closed position due to the forces generated by the high pressure oil present in lower oil passage 19.

A piston 9 is attached to one end of the engine valve 5 and vertically traverses a piston cavity 17 formed in the body of the upper actuator housing 4A as the valve 5 moves upward and downward to open and close at the command of the electronic control unit 8 which sends electrical signals to the control solenoid 6. The lower actuator housing 4B sits on and can move relative to the head surface 18 thereby allowing the lower actuator housing 4B to self-position to minimize friction and wear between the lower actuator housing 4B and the engine valve 5 as they move relative one to the other. The lower actuator housing 4B is hydraulically sealed to the upper actuator housing 4A by way of sealing ring 14 which expands to contact in a sealing manner both the upper and lower actuator housing 4A and 4B.

The supply header 12 is stationary with respect to the engine cylinder head 16 and provides for a stable mounting surface and a source of high pressure engine or hydraulic oil for the hydraulic valve actuator 2. The upper actuator housing 4A has a relatively flat actuator surface 22 which contacts and supports against the supply surface 24 where the overall effect is to trap the hydraulic valve actuator 2 between the supply surface 24 and the head surface 18. In this manner, the hydraulic valve actuator 2 is free to position itself between the supply header 12 and the engine cylinder head 16 thereby self-aligning with the engine valve 5 to minimize friction and wear.

Now referring to FIG. 2, a front elevational view of the control solenoid 6 of the present invention is shown. The solenoid housing 15 is attached to a mounting flange 26 for mounting to the side of the upper actuator housing 4A and lower actuator housing 4B as shown in FIG. 1. Fasteners such as bolts are fitted through fastener openings 28. The electronic control unit 8 is electrically connected to the coil 13 with electrical leads 34 which pass through the connector access 30.

FIG. 3 is a side cross-sectional view of the control solenoid 6 of the present invention taken along line III—III of FIG. 2. A coil bobbin 32, commonly made of a nonconductive, nonmagnetic plastic material is shown. The coil 13 is wound around the coil bobbin 32 which slides onto the coil ring 11 into the coil pocket 31 formed by the solenoid housing 15 and the coil ring 11 attached thereto. The coil 13 is connected to the electronic control unit 8 using electrical leads 34 which pass through the connector access 30. A cover plate 36 holds the coil bobbin 32 in place and serves to complete the magnetic circuit. The control solenoid 6 would operate without the cover plate 36 but with reduced performance. The solenoid housing 15, coil ring 11 and cover plate 36 are typically made of a magnetically permeable material such as mild steel. It is preferable from a magnetic standpoint to make the solenoid housing 15 and the coil ring 11 as one continuous piece. The return spring 7, which is shown as a coil spring but could be any type of suitable spring device, acts against the spool valve 10 to move it in a rightward direction.

FIG. 4 is a bottom elevational view of the control solenoid 6 of the present invention. Airflow holes 38 are drilled in the solenoid housing 15 to allow a cooling effect to take place due to enhanced airflow over the coil 13 to lower the operating temperature which is especially important when operating in a vehicle underhood environment. Solenoid performance can degrade at high operating temperatures and the control solenoid 6 of the present invention has been specifically designed to maximize performance in extreme environments.

Now referring to FIG. 5 of the drawings, a side elevational view of the spool valve assembly 10 of the present invention is shown. As described with reference to FIG. 1, the spool valve 10 of the present invention is used to control the flow of high pressure hydraulic oil for use in activating an engine valve 5 according to commands received from the electronic control unit 8 which supplies electrical current to the electrical control solenoid 6 which, in turn, magnetically attracts a spool ring 52 which is positioned on shank section 53 adjacent to a first sealing section 54 of the spool valve 10. Thus, the axial position of the spool valve 10 is controlled by the magnetic interaction between the control solenoid 6 and the spool ring 52 and by the return spring 7. The spool ring 52 is made of a magnetically reactive material such as soft iron which may or may not be magnetized, and is attached to the spool valve body 55, which is made of a lightweight nonmagnetic material such as aluminum, by a suitable fastening means such as a press fit, adhesive or using a securing pin. The first sealing section 54 is attached to a flow port section 58 which, when moved in alignment with a high pressure hydraulic port, allows the hydraulic oil flow from one side of the flow port section 58 to a center bore 68 which vents to atmosphere through the side holding the spool ring 52.

The flow control section 56 of the spool valve 10 is typically the same diameter as the first sealing section 54 both of which are used to seal the hydraulic oil by maintaining a tight diametrical clearance (typically 0.0002 inches with the valve bore 23). Sealing lands 64 are likewise sized for a close clearance, typically 0.0002 inches diametrical clearance, within the actuator valve bore 23 formed in the upper actuator housing 4A by keeping the spool valve 10 centered in the valve bore 23 using the centering grooves 66 to help distribute the high pressure oil around the periphery of the spool valve 10. The centering grooves 66 and the sealing lands 64 combine to comprise a second sealing section 62 which prevents the migration of the high pressure hydraulic oil outside of the valve actuator 2. A bridge section 50 joins the second sealing section 62 to the flow control section 56. High pressure oil from oil port 20 surrounds the bridge section 50 since it has a smaller outside diameter than the valve bore 23. The magnetic field induced by coil 13 draws the spool ring 52 into the field against the coil ring 11 thereby moving the spool valve 10 leftward against the force created by the return spring 7 which tends to force the spool valve 10 to the right.

The spool ring 52 has a plurality of castellation channels 70 and 72 formed on, respectively, a leftward and rightward face thereof. The castellation channels 70 and 72 function to reduce the forces necessary to axially move the spool valve 10 when the spool ring 52 is positioned against the coil armature ring 11 or the upper actuator housing 4A respectively. A "stiction force" is created when a thin film of hydraulic fluid resides between the spool ring 52 and another parallel flat surface such as the upper actuator housing 4A or the coil armature ring 11 which can significantly slow the response of the spool valve 10. The castellation channels 70 and 72 function to reduce this force and allow the spool valve 10 to easily move leftward upon energization of the coil 13 and return upon de-energization of the coil 13.

The shank section 53 and first sealing section 54 and flow port section 58 and flow control section 56 and bridge section 50 and second sealing section 62 combine to make up the spool valve body 55 on which the spool ring 52 is attached. The spool valve body 55 can be made of one homogeneous lightweight material, such as aluminum, which can be anodized and/or coated for low friction and enhanced wear characteristics while the spool ring 52 must be made of a magnetic material such as soft iron.

The flow port section 58 is pierced by a plurality of hydraulic oil ports 60 which communicate to the center bore 68. The center bore 68 extends axially through the spool valve 10 and can be blocked at one end by a balance plug 74 if the hydraulic flow forces combine to tend to move the spool valve 10 leftward while the coil 13 is de-energized and the return spring 7 is moving it rightward to vent the high pressure oil residing in the upper piston cavity 17 through the oil ports 60. The purpose of the balance plug 74 is to balance the hydraulic flow forces during the engine valve 5 closing cycle such that the spool valve 10 is not inclined to unintentionally open to high pressure unless the coil 13 is energized and motion is desired.

The description above refers to particular embodiments of the present invention and it is understood that many modifications may be made without departing from the spirit thereof. The embodiments of the invention disclosed and described in the above specification and drawings are presented merely as examples of the invention. Other embodiments, materials, forms and modifications thereof are contemplated as falling within the scope of the present invention only limited by the claims as follows.

I claim:

1. A control solenoid for an engine valve hydraulic actuation device comprising:

a housing forming a cavity, said housing made of a magnetically conductive material;

a magnetically conductive coil ring mounted within said cavity, said coil ring being tubular in shape and axially extending from said housing to form a coil pocket;

an electrical coil wound around said coil ring disposed within said coil pocket;

a spool valve having a magnetically active spool ring attached thereto for magnetic interaction with said electrical coil and said coil ring causing said spool valve to axially move to control the flow of a hydraulic oil, said spool ring comprised of a first face and a second face each having castellation channels formed therein for reducing oil film stiction forces;

a control unit electrically connected to said coil for generating an electrical signal in said coil to cause said coil to magnetically attract said spool ring;

a return spring acting on said spool valve to oppose the magnetic forces generated by said electrical coil.

2. The control solenoid of claim 1, wherein said castellation channels radially extend along said first and second face.

* * * * *